US006783293B2

(12) United States Patent
Watanabe et al.

(10) Patent No.: US 6,783,293 B2
(45) Date of Patent: Aug. 31, 2004

(54) COMBINATION COATING FILM TRANSFER AND WRITING IMPLEMENT

(75) Inventors: Kazuya Watanabe, Osaka (JP); Masahiko Ono, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 10/636,838

(22) Filed: Aug. 7, 2003

(65) Prior Publication Data

US 2004/0028461 A1 Feb. 12, 2004

(30) Foreign Application Priority Data

Aug. 12, 2002 (JP) ..... 2002-234779

(51) Int. Cl.[7] ..... B43K 29/00; A46B 11/00; B05C 1/14

(52) U.S. Cl. ..... 401/195; 401/16; 401/17; 118/257

(58) Field of Search ..... 401/195, 16, 17, 401/21, 23; 118/76, 257; 156/577, 579

(56) References Cited

U.S. PATENT DOCUMENTS 6,461,068 B1 * 10/2002 Holmes ..... 401/17
6,582,514 B1 * 6/2003 Yang ..... 118/76

FOREIGN PATENT DOCUMENTS

| | | |
|---|---|---|
| JP | 10-25056 | 1/1998 |
| JP | 10-181288 | 7/1998 |
| JP | 10-181985 | 7/1998 |

* cited by examiner

*Primary Examiner*—David J. Walczak
(74) *Attorney, Agent, or Firm*—Howson & Howson

(57) ABSTRACT

In a combination coating film transfer tool and ball-point pen, the transfer tool comprises a case, and a replacement cassette comprising supply and take-up reels and a transfer head. The cassette fits tightly, but removably, in the case, with the tip of the transfer head projecting from the case. The cassette is replaced from time to time, but the case can be reused. Consequently waste of plastic is reduced, and the replacement units can be manufactured less expensively.

7 Claims, 4 Drawing Sheets

COMBINATION COATING FILM TRANSFER AND WRITING IMPLEMENT

FIELD OF THE INVENTION

This invention relates to coating film transfer tools for transferring a coating film for correction, an adhesive, a decorative coating film, etc., to a receiving surface. It relates particularly to a transfer tool made integral with a writing implement.

BACKGROUND OF THE INVENTION

In the past, various products have been developed which incorporate a coating film transfer tool integrated with a writing implement such as a ball-point pen. Moreover, in some cases, the coating film transfer tool is replaceable. For example, Unexamined Japanese Patent Publication 25056/1998 discloses a coating film transfer tool integrated with a writing implement, as shown in FIG. 5. This coating film transfer tool, which is integral with a writing implement 60, comprises a case 61, divided into two parts, and a transfer head 64, which presses against a receiving surface. A transfer tape T in the transfer head, has a transferable agent, such as an adhesive or a correcting agent, laminated on its surface. The transfer head transfers the transferable agent to a receiving surface. The case 61 comprises two case elements, 61A and 61B. Each case element is assembled by engaging two plate-shaped members. The case elements 61A and 61B are removably coupled by a joint member 66 having recesses which receive end portions of the case elements in facing relationship to each other. The case element 61A functions as a coating film transfer tool, and the case element 61B functions as a pen, having a pen point 68 and a removable cap 69 covering the point.

Unexamined Japanese Patent Publication 181288/1998 and Unexamined Japanese Patent Publication 181985/1998 disclose another coating film transfer tool 70 integrated with a writing implement, as shown in FIG. 6. This tool 70 comprises a pen section 72, which is integrated through a tubular coupling 71 with a coating film transfer tool 73. A projection provided on the coating film transfer tool 73 is engaged with a hole formed in the coupling 71 and thus, the coating film transfer tool 73 is removably connected with the coupling 71.

In these conventional instruments, the writing implement, typically a ball-point pen, has a relatively long life, whereas the coating film transfer tool has a relatively short life. Consequently the coating film transfer tool must be replaced frequently. Although only the coating film supply in the transfer tool is exhausted, the entire transfer tool, including its outer case, is disposed of at the time of replacement. The disposal of the outer case, which is usually made of plastics, is a waste of resources. Moreover, when the plastic is burnt in the disposal process, harmful gas is generated, causing environmental pollution.

SUMMARY OF THE INVENTION

In the combination coating film transfer tool and writing implement in accordance with the invention the coating film transfer tool comprises a case and a replacement cassette. The replacement cassette comprises a supply reel of transfer tape comprising a base material tape coated with a coating film, a transfer head having a tip portion for pressing and transferring the coating film onto a receiving surface, and a take-up reel. The base material tape extends from the supply reel, and past the transfer head to the take-up reel, so that the base material tape can be wound onto the take-up reel as the coating film is transferred onto a receiving surface. The replacement cassette is disposed in the case, with at least the tip portion of the transfer head projecting from the case, and the replacement cassette is removable from the case so that only the cassette needs to be replaced, and the case can be re-used.

Means are preferably provided on the inner surface of the case, for engagement with the replacement cassette, to prevent rotation of the replacement cassette relative to the case. In a preferred embodiment, the engagement means is a D-shaped element, and the replacement cassette has a cut-out section complementary to the D-shaped element.

One or more protectors are preferably provided on the replacement cassette for preventing a user's finger from directly touching the transfer tape.

According to the invention, since a coating film transfer tool of a coating film transfer tool made integral with a writing implement is a replacement cassette type, further utilization of plastic resources and reduction of waste plastic are possible as compared with a conventional method of disposing of the whole coating film transfer tool.

BRIEF DESCRIPTION OF THE DRAWINGS

FIG. 4(*b*) is a right side view of the replacement cassette;

FIG. 4(*c*) is a bottom plan view of the replacement cassette;

FIG. 4(*d*) is an end view of the replacement cassette, as seen in the direction of arrow A in FIG. 4(*a*);

DETAILED DESCRIPTION OF THE PREFERRED EMBODIMENTS

Figure 1:
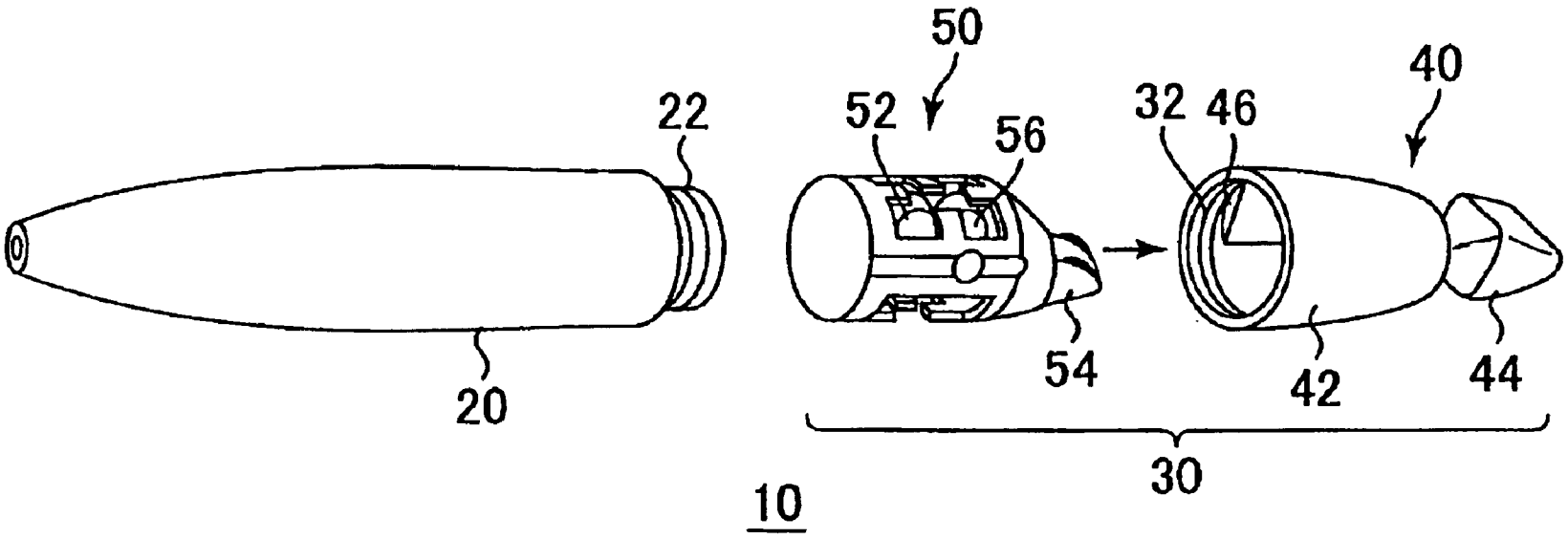
FIG. 1 is an exploded perspective view of a coating film transfer tool integrated with a writing instrument, according to the invention.

As shown in FIG. 1, the combined coating film transfer tool and writing implement 10 in accordance with the invention comprises a writing section 20, and a coating film transfer tool 30 engaged with the writing section 20 by threads. The coating film transfer tool 30 comprises a case 40 and a replacement cassette 50, which is placed in the case 40, removably but tightly. The replacement cassette 50 comprises a tape supply reel 52 from which a transfer tape is unwound. The transfer tape comprises a base material coated with a coating film. The cassette also comprises a transfer head 54 for pressing and transferring the coating film onto a receiving surface, and a take-up reel 56, onto which the base material tape is wound after the coating film is transferred.

With the above-described structure, the amount of waste plastic is reduced, since the case 40 may be reused, and only the cassette 50 needs to be replaced when the transfer tape of is used up.

The case 40 comprises a main body 42, and a cap 44 which is removable from the main body. In the embodiment illustrated in FIG. 1, to connect the coating film transfer tool 30 to the writing section 20, a female threaded section 32 of the coating film transfer tool 30 is engaged with a male threaded section 22 of the writing section 20. However, any of a wide variety of other connection schemes may be adopted to connect the two main components. For example, frictional fitting, engagement through an intermediate member, or press fitting, may be used.

Figure 2:
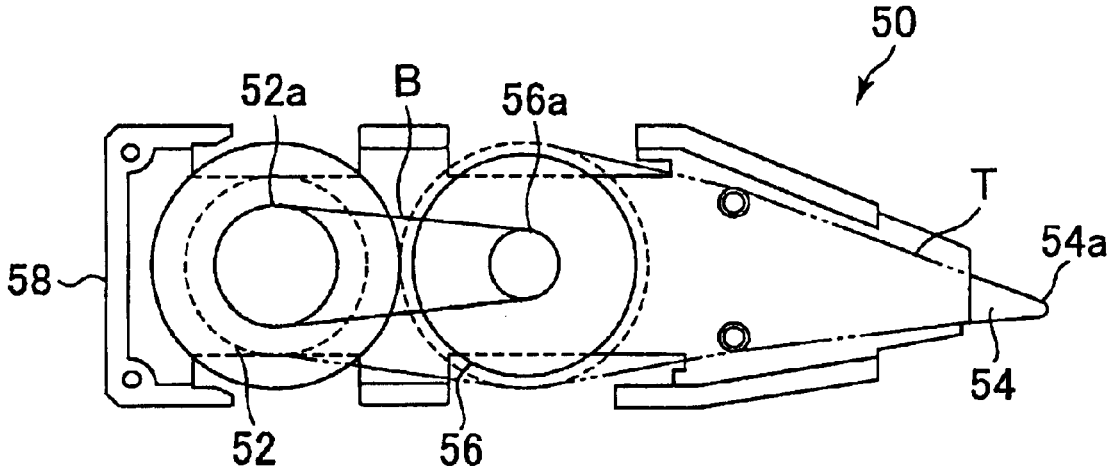
FIG. 2 is a cross-sectional view of a replacement cassette.

As shown in FIG. 2, the replacement cassette 50 comprises a cassette case 58 having two spindles 52*a* and 56*a*. A transfer head 54 protrudes outwardly from an end of the case, and has a pressing transfer section 54*a* at its tip. The cassette also includes a tape supply reel 52 and a take-up reel 56, which are rotatable on the spindles 52*a* and 56*a* respectively. The tape supply reel comprises a transfer tape T, comprising a tape base material coated with a coating film, wound on spindle 52*a*. The base material is wound onto the spindle 56*a* as the take-up reel 56.

As in the case of a conventional transfer tool, as the transfer tape T is unreeled from the supply reel 52, the coating film is transferred to a receiving surface, and only the base material tape is reeled onto the take-up reel 56. In the replacement cassette 50 of FIG. 2, the supply reel 52 and the take-up reel 56 are linked by an endless rubber belt B, so that the supply reel 52 and the take-up reel 56 rotate cooperatively.

Figure 3:
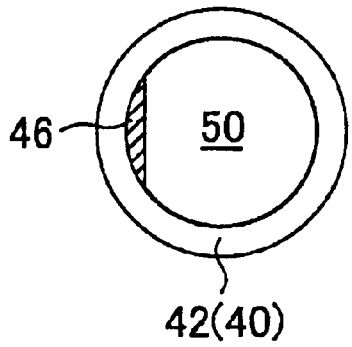
FIG. 3 is a cross-sectional view showing a replacement cassette placed in the main body section of a case.
Figure 4A:
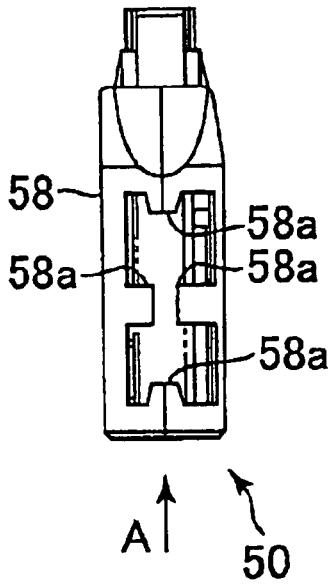
FIG. 4(*a*) is a top plan view of the replacement cassette.
Figure 4B:
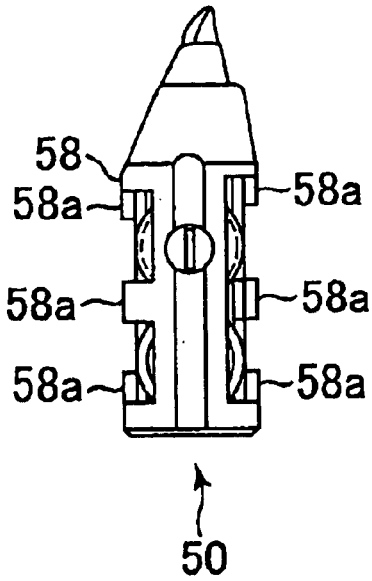
Figure 4C:
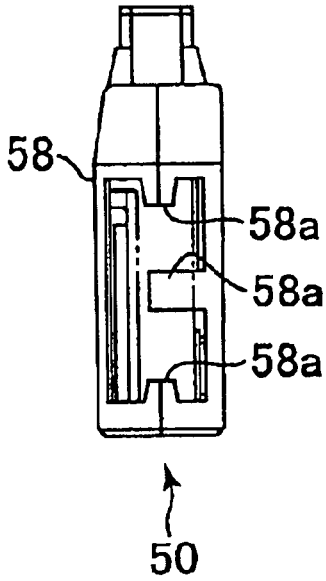
Figure 4D:
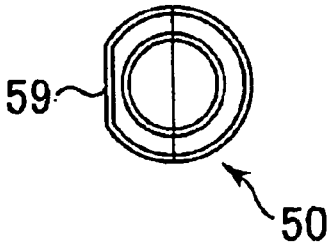
Figure 5:
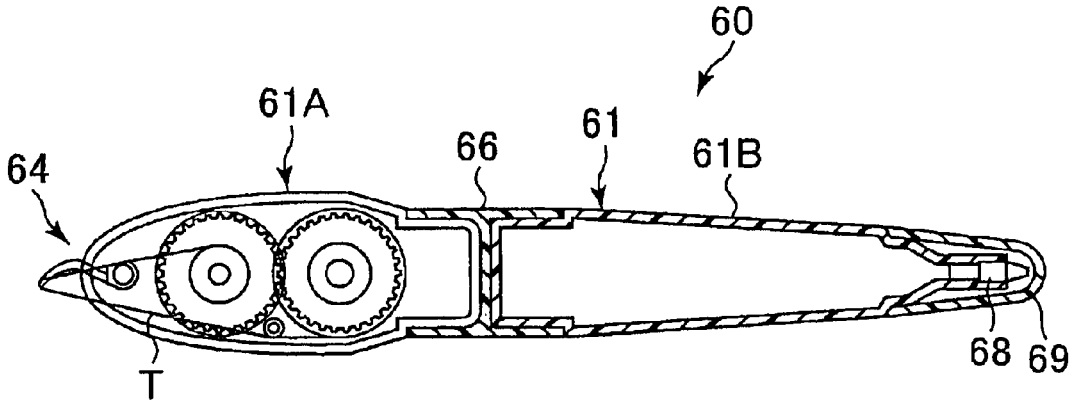
FIG. 5 (PRIOR ART)
FIG. 5 is a schematic cross-sectional view of a conventional coating film transfer tool integrated with a writing implement.
Figure 6:
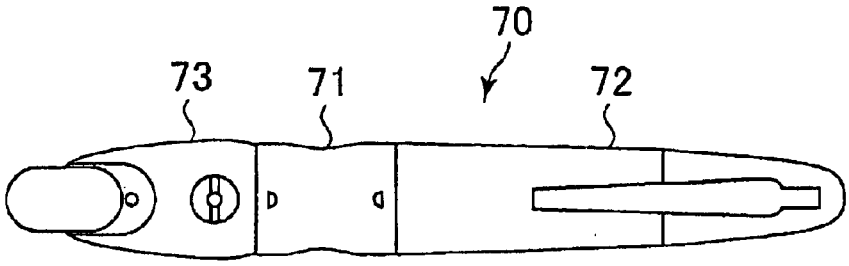
FIG. 6 (PRIOR ART)
FIG. 6 is a front elevational view of another conventional coating film transfer tool integrated with a writing implement.

As shown in FIG. 3, the replacement cassette 50 fits tightly in the main body 42 of case 40. A D-shaped element 46, provided in the inner surface of the case is engaged with the replacement cassette 50. The replacement cassette has a shape complementary to that of the D-shaped element, so that the cassette is prevented from rotating and from being inserted upside-down. Thus, the external shape of the replacement cassette 50 is the same as the internal shape of the interior space of the case. Of course element 46 is not limited to a D shape, and can be any shape that prevents the replacement cassette 50 from rotating and being inserted in the wrong direction.

As shown in FIGS. 4(*a*)–4(*d*), the cassette case 58 of the replacement cassette 50 need not be entirely covered, and preferably has an open structure, being composed only of those members which are necessary for adequate strength. Thus, the amount of plastic material in the replacement cassette can be substantially less than the amount of plastic material in a conventional replaceable transfer tool unit. Where the cassette has an open structure, one or more protectors 58*a* are provided on the cassette case 58 to prevent the user's fingers from contacting and sticking to the coating film when the cassette is handled in the process of replacement.

As shown in FIG. 4(*d*), a flat part 59 is provided on the outer surface of the replacement cassette 50. This flat part is complementary to the flat interior wall formed by the D-shaped element 46 in the main body 42 of the case 40. This flat part 59 allows the replacement cassette to fit non-rotatably in the case 40 when the replacement cassette 50 is placed in the case. The gap between the replacement cassette 50 and the inner surface of the case 40 is preferably made as small as possible.

According to the invention, the replacement cassette reduces the waste of plastic compared with the conventional integrated transfer tool-writing implement, in which the entire coating film transfer tool is replaced. As a result, a significant cost reduction may realized. In addition, the replacement cassette can be prevented from rotating and from being inserted in the wrong direction, by providing an engaging means which is engageable with a replacement cassette in the inner surface of the case. The replacement cassette can be prevented from rotating, and from being inserted in the wrong direction by providing a D shaped element in the case, and giving the replacement cassette a shape complementary to the D-shaped element. Furthermore, by providing a protector on a replacement cassette, the user's fingers can be prevented from directly touching the transfer tape when a cassette is replaced.

What is claimed is:

1. A combination coating film transfer tool and writing implement comprising a coating film transfer tool and a writing implement connected to each other, wherein:

the coating film transfer tool comprises a hollow case and a replacement cassette;

said replacement cassette comprises a cassette case, a supply reel of transfer tape located inside the cassette case and mounted for rotation on an axis in fixed relationship with the cassette case, said supply reel comprising a base material tape coated with a coating film, a transfer head connected to said cassette case and having a tip portion for pressing said tape and thereby transferring said coating film onto a receiving surface, and a take-up reel also located inside the cassette case and mounted for rotation on an axis in fixed relationship with the cassette case, said replacement cassette being receivable as a unit in said hollow case with said tip portion projecting from said hollow case, and said cassette being removable as a unit from said hollow case; and said base material tape extends from the supply reel, and past the transfer head to the take-up reel, whereby the base material tape can be wound onto the take-up reel as the coating film is transferred onto a receiving surface.

2. A combination coating film transfer tool and writing implement as claimed in claim 1, having means, on the inner surface of said hollow case, engageable with the replacement cassette, for preventing rotation of the replacement cassette relative to the hollow case.

3. A combination coating film transfer tool and writing implement as claimed in claim 2, in which said cassette case has an outer wall with at least one opening leading from the interior to the exterior of the cassette case, and protector means on said cassette case for preventing a user's finger from directly touching said transfer tape through said opening.

4. A combination coating film transfer tool and writing implement comprising a coating film transfer tool and a writing implement removably connected to each other, wherein:

the coating film transfer tool comprises a case and a replacement cassette;

said replacement cassette comprises a supply reel of transfer tape comprising a base material tape coated with a coating film, a transfer head having a tip portion for pressing and transferring said coating film onto a receiving surface, and a take-up reel;

said base material tape extends from the supply reel, and past the transfer head to the take-up reel whereby the base material tape can be wound onto the take-up reel as the coating film is transferred onto a receiving surface;

said replacement cassette is disposed in said case with at least the tip portion of the transfer head projecting from the case, and said replacement cassette is removable from said case and means, on the inner surface of said case, engageable with the replacement cassette, for preventing rotation of the replacement cassette relative to the case;

wherein said means engageable with the replacement cassette, is a D-shaped element, and said replacement cassette has a cut-out section complementary to said D-shaped element.

5. A combination coating film transfer tool and writing implement as claimed in claim 4, having protector means on said replacement cassette for preventing a user's finger from directly touching said transfer tape.

6. A combination coating film transfer tool and writing implement as claimed in claim 1, in which said cassette case has an outer wall with at least one opening leading from the interior to the exterior of the cassette case, and protector means on said cassette case for preventing a user's finger from directly touching said transfer tape through said opening.

7. A combination coating film transfer tool and writing implement as claimed in claim 1, wherein the coating film transfer tool and the writing implement are removably connected to each other.

* * * * *